US007527535B2

(12) United States Patent
Mueller et al.

(10) Patent No.: US 7,527,535 B2
(45) Date of Patent: May 5, 2009

(54) SYSTEM FOR ELECTRICAL CONTACTING

(75) Inventors: Hans-Peter Mueller, Reutlingen (DE); Wolfgang Jacob, Horb (DE); Ulrich Trescher, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/603,609

(22) Filed: Nov. 21, 2006

(65) Prior Publication Data

US 2007/0264886 A1 Nov. 15, 2007

(30) Foreign Application Priority Data

Nov. 21, 2005 (DE) ..... 10 2005 054 862

(51) Int. Cl.
*H01R 13/05* (2006.01)

(52) U.S. Cl. ..... 439/825

(58) Field of Classification Search ..... 439/825, 439/75, 734, 851, 74, 46, 82, 295, 426, 320, 439/933, 752.5, 751, 733.1, 680; 438/613–615
See application file for complete search history.

(56) References Cited

U.S. PATENT DOCUMENTS 4,374,604 A * 2/1983 Hemmer et al. ..... 439/587
4,854,900 A 8/1989 Muhlhoff
5,557,504 A * 9/1996 Siegel et al. ..... 361/773
5,564,954 A * 10/1996 Wurster ..... 439/751
6,325,280 B1 * 12/2001 Murphy ..... 228/246
6,851,962 B2 * 2/2005 McCormack, III ..... 439/276
7,086,870 B1 * 8/2006 Sutcliffe ..... 439/75
2002/0007967 A1 1/2002 Yamanashi et al.

FOREIGN PATENT DOCUMENTS

| | | |
|---|---|---|
| DE | 3221844 | 12/1984 |
| DE | 4024456 | 2/1992 |
| DE | 19640466 | 4/1998 |
| FR | 1280177 | 12/1961 |

* cited by examiner

*Primary Examiner*—Edwin A. Leon
(74) *Attorney, Agent, or Firm*—Kenyon & Kenyon LLP

(57) ABSTRACT

In a system for the electrical contacting of at least one connection element of an electronic circuit in a hermetically sealed housing with a conductor element having a base plate for holding the at least one connection element, the conductor element is provided with a press-in pin which may be pressed-in in one section of the connection element to form a contact.

16 Claims, 2 Drawing Sheets

SYSTEM FOR ELECTRICAL CONTACTING

BACKGROUND OF THE INVENTION

1. Field of the Invention

The present invention relates to a system for the electrical contacting of at least one connection element of an electronic circuit in a housing with a conductor element.

2. Description of Related Art

Hermetically sealed housings are currently available in various designs having a variety of electronic circuits, such as sensors or control devices in the field of transmission technology. One design of such a hermetic housing has a base plate through which connector pins for the electrical connector for the circuit inside the housing are inserted. During manufacture the connector pins are inserted into receiving holes in the base plate, which has a glass blank. Melting of the glass at appropriate temperatures and subsequent cooling results in a secure, electrically insulated bond between the connector pins and the base plate. The electronic circuit is electrically connected to the connector pins by use of a bonding technique, for example. The base plate together with the circuit situated thereon is then sealed with a cover, which is securely welded to the base plate under a protective atmosphere, thereby forming a hermetically sealed housing. The cover and the housing are therefore made of a material intended for high processing temperatures and welding, such as steel, for example.

The connector pins which project outwardly from the base plate are usually cylindrical solid wires made of specific alloys that are suitable for the remelting process using glass. The connector pins are externally welded by laser or soldered to electrical conductor elements, such as conductor rails or pressed screens, for example.

In the case of various applications, transmission technology for example, certain boundary conditions do not allow soldering as a method for contacting the connector pins with the electrical conductor elements, so that the connections are made by laser welding. This method is carried out in a sequential manner. Complex machines and equipment are required for laser welding. Process management has proven to be very problematic, with a high number of rejects.

BRIEF SUMMARY OF THE INVENTION

In contrast to the related art, the system according to the present invention for the electrical contacting of at least one connection element of an electronic circuit in a hermetically sealed housing with a conductor element has a press-in connection between the conductor element and the connection element. This has the advantage that the machines and equipment required for a laser welding method are omitted, thus eliminating the associated high reject rate, and the associated energy costs are also reduced.

A further advantage is that the contactings are not sequential as was previously the case, but instead are produced simultaneously in one manufacturing step, thus reducing the manufacturing time.

In one example system according to the present invention for the electrical contacting of at least one connection element of an electronic circuit in a hermetically sealed housing with a conductor element, having a base plate for holding the at least one connection element, the conductor element is provided with a press-in pin which may be pressed into a receiving section of the connection element to form a contact.

In its longitudinal direction, in series behind the receiving section for receiving the press-in pin, the connection element has a fastening section for fastening the connection element in the base plate, and has a connection section for connecting the electronic circuit. Positioning of these sections one behind the other helps prevent damage in the individual functional sections, thus enabling the press-in procedure for contacting to be advantageously carried out in a uniform manner.

In one example embodiment, the receiving section of the connection element has a receptacle having an inlet for the press-in pin, thus allowing reliable insertion of the press-in pin during the press-in procedure, and a secure contacting seat for same.

The receiving section of the connection element has a press-in section which is provided for contacting the press-in pin, it being preferred for the receiving section of the connection element to have a circular cross section.

For contacting in the press-in section of the receptacle of the connection element, the press-in pin has an elastic press-in element which ensures secure contacting. For this purpose, the elastic press-in element is provided with a press-in contour by which a press-in force into the receptacle of the connection element and a contact pressure force in the receptacle of the connection element may be specified in advance. This advantageously allows the press-in procedure for all press-in pins in the connection elements to be carried out simultaneously with a defined press-in force. Furthermore, the contact pressure force for the press-in element inside the receptacle of the connection element may thus be advantageously influenced.

It may be provided for the press-in pin to have an opening in the region of the elastic press-in element.

In a further example embodiment, the press-in pin is designed as one piece with the conductor element. For example, the conductor element may be a component of a pressed screen, it being possible for the press-in pin to be produced in one work step during the manufacture thereof.

For advantageous threading of the press-in pin into the receptacle of the conductor element, the front section of the press-in pin has a polygonal cross section which increases toward its middle section. The polygonal cross section has the further advantage that these edges are indented to a certain extent into the receptacle, thereby ensuring proper insertion and a hold that is secured against rotation. In addition, the rear section of the press-in pin has a stop which ensures a predetermined press-in depth of the press-in pin in the receptacle of the connection element. This ensures that the contacting of the press-in element occurs in a predetermined press-in section.

DETAILED DESCRIPTION OF THE INVENTION

Figure 1:
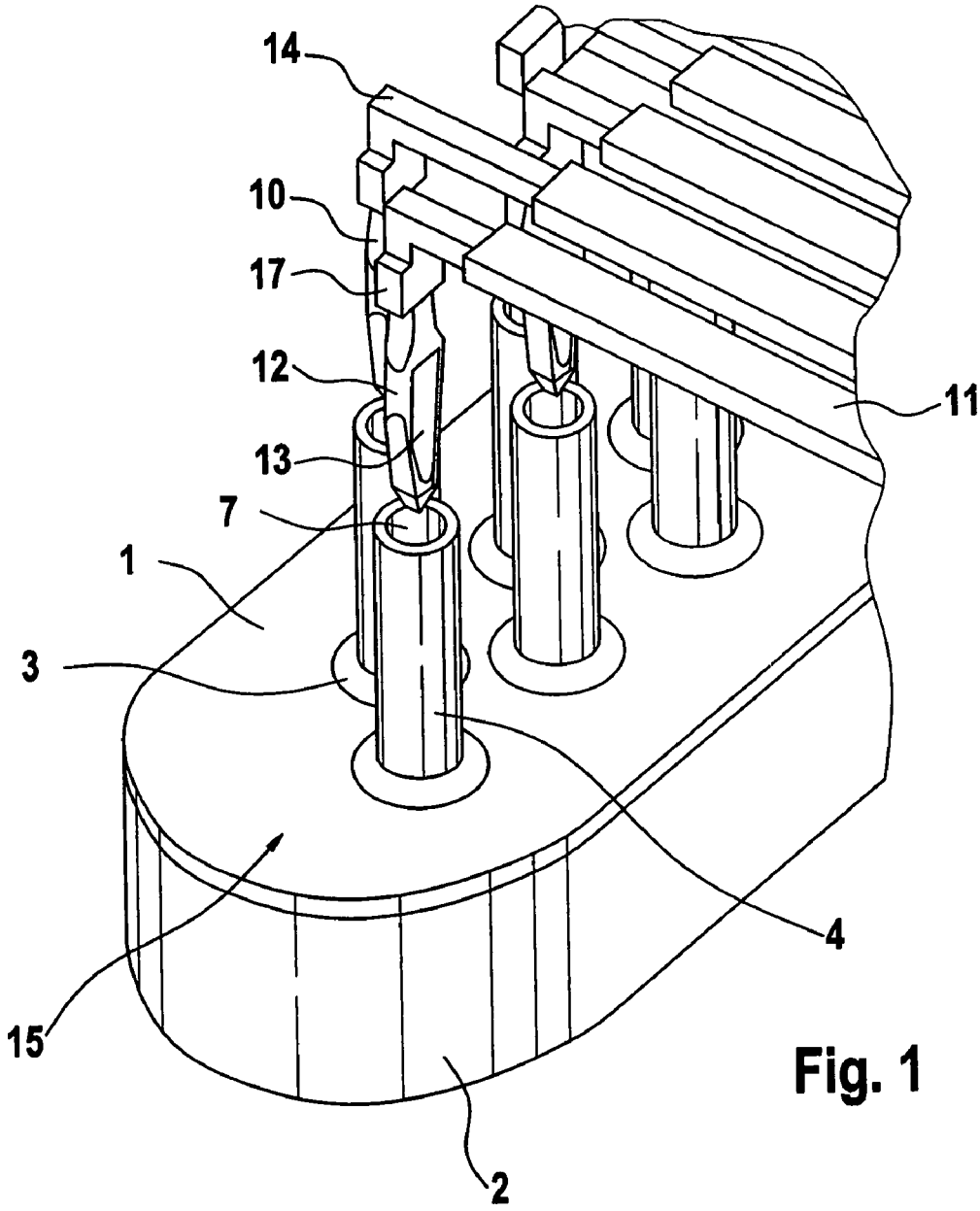
FIG. 1 shows one exemplary embodiment of a system according to the present invention in a state prior to a press-in procedure.

FIG. 1 illustrates an exemplary embodiment of a system according to the present invention for contacting connection elements 4 with conductor elements 11 prior to a contacting process.

A hermetically sealed housing 2 in which, for example, an electronic circuit (not illustrated) is situated is shown only schematically. Housing 2 is sealed by a base plate 1. Base plate 1 has openings into which connection elements 4 are inserted. Inside housing 2, connection elements 4 are electrically connected to the electronic circuit. The connection elements are positioned in such a way that they form a connection series 15 having offset connection elements 4. Of course, other systems are possible.

Connection elements 4 are inserted into base plate 1 in a tight, insulated, secure manner by use of fastening elements 3. This fastening element 3 is preferably made of glass. In each case, glass in the form of a blank is inserted together with a connection element 4 into the opening in base plate 1, is subsequently melted by introducing heat, and, once cool, then forms a fastening element 3.

In this example, connection elements 4 have a cylindrical design and have receptacles 7 which point away from base plate 1. These receptacles 7 are designed with a circular cross section and extend in the longitudinal direction of connection elements 4, as explained below and shown in FIG. 2. Receptacles 7 are provided for press-in pins 10, which are illustrated in FIG. 1 in a position above the receptacles.

Press-in pins 10 are connected to conductor elements 11 via a crossover 14. Conductor elements 11 are, for example, components of a known conductor frame or a pressed screen which connects the electronic circuit in housing 2 to other control components. In this example, press-in pins 10 are positioned at right angles to conductor elements 11, but other configurations are also possible.

Prior to the contacting, i.e., press-in procedure, the conductor frame together with conductor elements 11 and press-in pins 10 is positioned as shown, in such a way that the centerlines of press-in pins 10 coincide with the centerlines of connection elements 4.

In its middle section, press-in pin 10 has a press-in element 12 for which the distance from either side of the centerline is greater than at the front section thereof. The external dimensions of press-in element 12 are designed to be larger by a certain degree than the diameter of the circular cross section of receptacle 7 of connection element 4. In this exemplary embodiment, press-in element 12 has an opening between two lateral sections, thereby allowing a certain elasticity of press-in element 12, which after the press-in procedure for press-in pin 10 into connection element 4 presses the lateral sections of press-in element 12 against the inner walls of receptacle 7 of connection element 4 for establishing and maintaining electrical contact. As a result of the structural design of press-in element 12 together with opening 13, it is advantageously possible to influence the press-in force as well as the contact pressure force for the lateral sections of press-in element 12 in a beneficial manner.

The front section of press-in pin 10 also has a pyramid-shaped tip, the edges of which continue in a subsequent section at a different angle up to press-in element 12. The length of these two front sections allows press-in pin 10 to be threaded and centered in receptacle 7 of connection element 4, resulting in a uniform course of the press-in procedure.

In its rear section, press-in pin has a stop 17 which is larger than the diameter of receptacle 7 of connection element 4, and which precisely specifies the press-in depth of the press-in pin. This ensures that press-in element 12 is positioned in a precisely defined press-in section 6 (see FIG. 2) for contacting.

Press-in pins 10 are pressed simultaneously into receptacles 7 of connection elements 4 for the entire system using a suitable apparatus.

Figure 2:
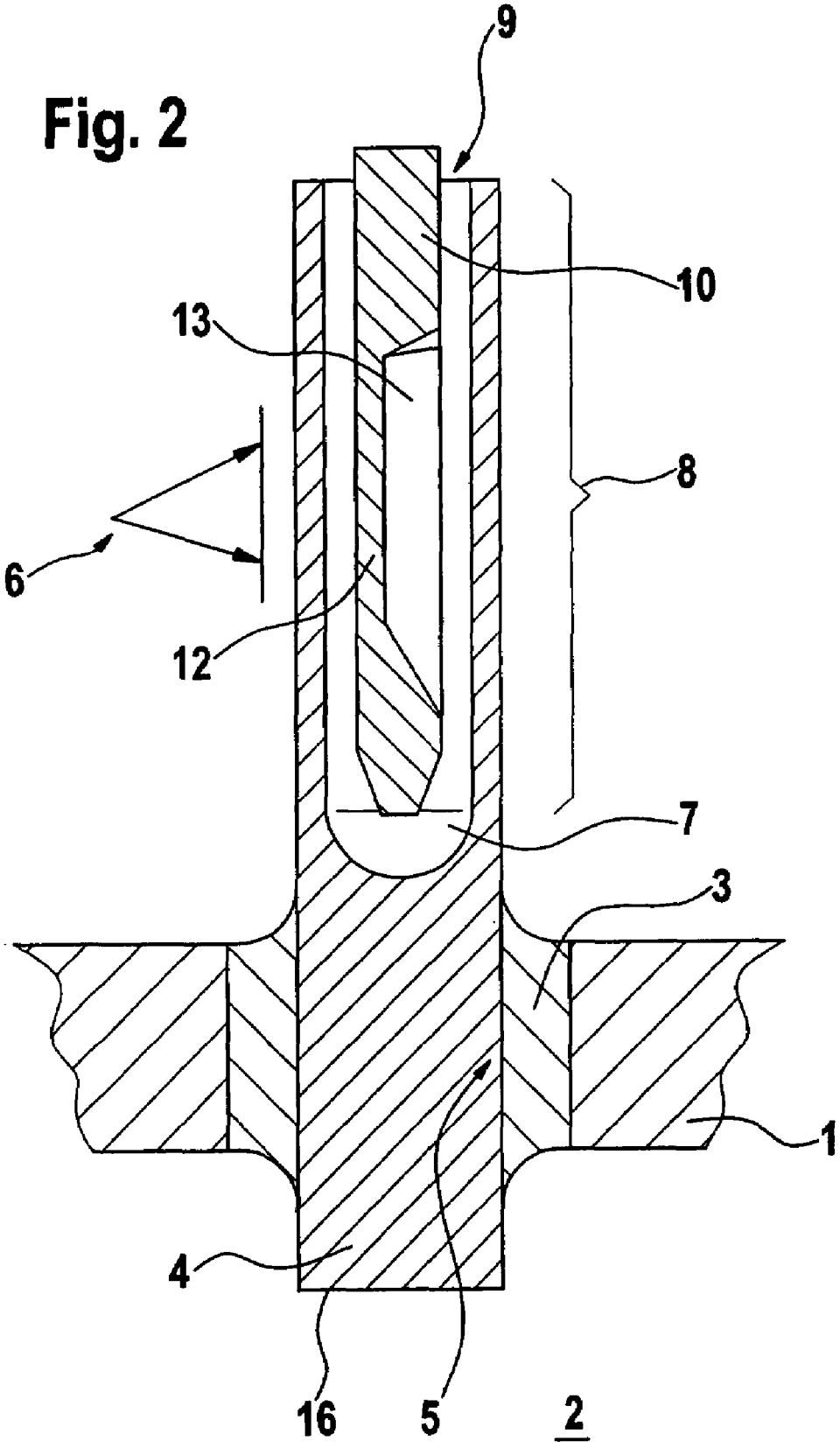
FIG. 2 shows a schematic sectional illustration of a connection element together with a pressed-in press-in pin.

The state following the press-in procedure is illustrated in FIG. 2, which shows a schematic sectional illustration of a connection element 4 together with a pressed-in press-in pin 10. The sectional plane is situated in the longitudinal direction of conductor elements 11 according to FIG. 1.

Connection element 4 has three sections which are positioned in series one behind the other in the longitudinal direction of the connection element. At one end, receptacle 7 together with its opening 9 begins as an inlet opening in a receiving section 8, which is adjoined by a fastening section 5 which at the other end of connection element 4 has a connection section 16.

Inlet 9 of receptacle 7 continues in receiving section 8, and occupies approximately two-thirds of the length of connection element 4. In this example, the inlet has a circular cross section, and approximately in the middle section thereof has a press-in section 6 in which the lateral sections of press-in element 12 together with the inner wall of receptacle 7 form an electrically conductive contact as a result of being pressed together. These lateral sections of press-in element 12 are not illustrated, but are perpendicular to the plane of the drawing. Opening 13 is situated between the lateral sections. The thickness of press-in pin 10 may be different, and is illustrated only schematically here.

Receiving section 8 adjoins fastening section 5, via which connection element 4 is connected via glass fastening element 3 to base plate 1. The tension forces originating from fastening element 3 have little or no influence on receiving section 8.

Connection section 16 of connection element 4, which is connected for example by use of a bonding technique to the electronic circuit (also not illustrated), is situated inside housing 2, which in FIG. 2 is situated beneath base plate 1 but is not further illustrated.

Connection element 4 is made of a material which has good electrical conductivity and at the same time is suitable for the heat treatment for melting the glass.

Press-in pin 10 is preferably produced as one piece from the same material as conductor element 11 and has special elastic characteristics in the region of press-in element 12 which may be influenced by known shaping, for example stamping and pressing.

A system for contacting is thus provided which as the result of a press-in procedure allows all connections of connection elements in a hermetically sealed housing to conductor elements in one processing procedure, it being possible to omit an energy-intensive welding process using correspondingly complex equipment.

The present invention is not limited to the exemplary embodiments described above, but, rather, may be modified in a variety of ways.

It is also possible for connection element 4 to have a pin shape and for press-in pin 10 to have a receptacle shape.

Press-in section 6 of connection element 4 may have a smaller cross section by providing additional wall thickness, for example, the wall in this section being radially thickened for this purpose by use of a suitable tool. Since the press-in depth of press-in pin 10 is determined by stop 17, the press-in section may be machined for this purpose in a targeted manner.

What is claimed is:

1. A system for electrical contacting, comprising:

a hermetically sealed housing;

a conductor element;

at least one connection element of an electronic circuit in the housing;

a base plate configured to hold the at least one connection element, wherein the base plate forms the ceiling of the hermetically sealed housing, and wherein the conductor element has a press-in pin, and wherein the press-in pin includes an elastic press-in element to be pressed into a receiving section of the connection element to form an electrical contact;

wherein the connection element has a fastening section for fastening the connection element in the base plate and a connection section inside the hermetically sealed housing for connecting the electronic circuit, and wherein the fastening section is located in series with the receiving section along a longitudinal axis of the connection element, and wherein the receiving section is a sleeve-shaped structure extending above the base plate.

2. The system as recited in claim 1, wherein the receiving section of the connection element has a circular cross section.

3. The system as recited in claim 1, wherein the press-in pin is configured as one piece with the conductor element.

4. The system as recited in claim 1, wherein the press-in pin includes a first portion with a polygonal cross section, wherein the polygonal cross section increases toward a second portion of the press-in pin, and wherein a third portion of the press-in pin includes a stop.

5. The system as recited in claim 1, wherein the housing is hermetically sealed by the base plate.

6. The system as recited in claim 1, wherein a plurality of connection elements are positioned to form a connection series having offset connection elements.

7. The system as recited in claim 1, wherein the fastening section includes a fastening element formed of glass.

8. The system as recited in claim 1, wherein the press-in pin is connected to the conductor element by a crossover.

9. The system as recited in claim 1, wherein the press-in pin is positioned at a right angle to the conductor element.

10. The system as recited in claim 1, wherein the connection section is situated inside the housing.

11. The system as recited in claim 1, wherein the receiving section of the connection element includes a receptacle having an inlet for the press-in pin, and wherein the receiving section and the fastening section are positioned directly in series one behind the other.

12. The system as recited in claim 11, wherein the inlet of the receptacle occupies approximately two-thirds of a length of the connection element.

13. The system as recited in claim 1, wherein the receiving section of the connection element has a press-in section for receiving the press-in pin.

14. The system as recited in claim 13, wherein the press-in section of the receiving section of the connection element is provided with additional wall thickness, thereby creating a smaller cross section.

15. The system as recited in claim 1, wherein the elastic press-in element has a contour specifying a predetermined press-in force into the receptacle of the connection element and a predetermined contact pressure force in the receptacle of the connection element.

16. The system as recited in claim 15, wherein the press-in pin has an opening in the region of the elastic press-in element.

* * * * *